United States Patent [19]

Geertsma et al.

[11] Patent Number: 4,896,421

[45] Date of Patent: Jan. 30, 1990

[54] SHAVING APPARATUS

[75] Inventors: Geert Geertsma; Hendrik Poel; Andreas F. J. Weersink, all of Drachten, Netherlands

[73] Assignee: U.S. Philips Corp., New York, N.Y.

[21] Appl. No.: 300,458

[22] Filed: Jan. 19, 1989

[30] Foreign Application Priority Data

Feb. 18, 1988 [NL] Netherlands ..... 8800405

[51] Int. Cl.[4] ..... B26B 19/14

[52] U.S. Cl. ..... 30/43.6; 30/346.51

[58] Field of Search ..... 30/43.5, 43.6, 346.51, 30/43.2

[56] References Cited

U.S. PATENT DOCUMENTS 4,038,748 8/1977 Tyler ..... 30/43.6

*Primary Examiner*—Douglas D. Watts

*Attorney, Agent, or Firm*—Ernestine C. Bartlett

[57] ABSTRACT

A shaving apparatus is provided having a housing provided with a holder for at least one shaving unit, which shaving unit comprises an external shaving member with hair entry apertures and an internal shaving member which is rotatable relative to the external shaving member, which internal shaving member is coupled to a drive mechanism by means of a drive shaft, which shaft comprises at least two portions which are axially movable to one another, the holder being provided with a mounting plate for the shaving unit, which holder and mounting plate are movable relative to each other in axially inward and outward directions. The external shaving member is secured to the mounting plate by means of at least one resilient element, so that the external shaving member with the mounting plate is also movable relative to the holder in both axial directions.

4 Claims, 2 Drawing Sheets

SHAVING APPARATUS

FIELD OF THE INVENTION

The invention relates to a shaving apparatus comprising a housing provided with a holder for at least one shaving unit, which shaving unit comprises an external shaving member with hair-entry apertures and an internal shaving member which is rotatable relative to the external shaving member, which internal shaving member is coupled to a drive mechanism by means of a drive shaft comprising at least two portions which are axially movable relative to each other, the holder being provided with a mounting plate for the shaving unit, which holder and mounting plate are movable relative to one another in axially inward and outward directions.

BACKGROUND OF THE INVENTION

Such an apparatus is known, for example from U.S. Pat. No. 4,137,629. In said apparatus the internal shaving member is urged against the external shaving member by means of a spring arranged in the drive shaft, the mounting plate being secured to the holder by means of a separate spring. In the fully depressed position of the shaving unit in which, when the external shaving member no longer projects from the holder, the force with which the shaving unit is applied to the skin to be shaved will always be the same regardless of the position of the mounting plate relative to the holder.

However, it is important that the user of the shaver can vary the maximum force between the shaving unit and the skin, for example depending on the sensitivity of the skin.

SUMMARY OF THE INVENTION

An object of the invention is to improve the shaving apparatus in this respect and to this end according to the invention the external shaving member is secured to the mounting plate by means of at least one resilient element, so that the external shaving member with the mounting plate is also movable relative to the holder in both axial directions.

Special embodiments of the invention are provided wherein the external shaving member is secured to the mounting plate by means of plate springs, the end of a plate spring being formed with a recess in which a flange of the external shaving member engages; and/or the apparatus comprises a holder for a plurality of shaving units, wherein the mounting plate is secured to the holder by means of a central resilient element and is axially movable relative to the holder by means of an annular adjusting member.

BRIEF DESCRIPTION OF THE DRAWING

An embodiment of the invention will now be described in more detail, by way of example, with reference to the Figures.

DETAILED DESCRIPTION OF THE PREFERRED EMBODIMENTS

Figure 1:
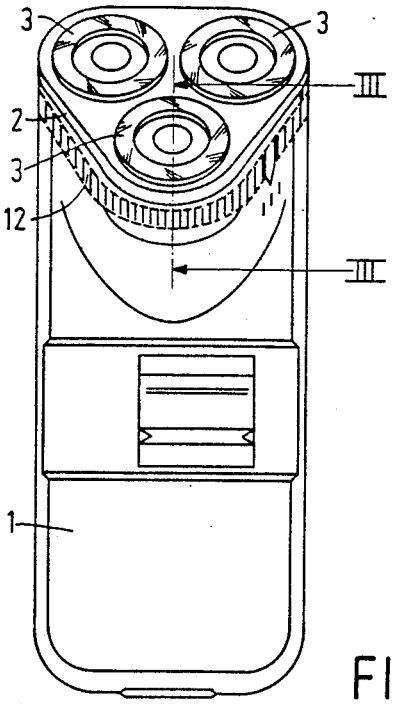
FIG. 1 is a front view of a shaving apparatus in accordance with the invention.
Figure 2:
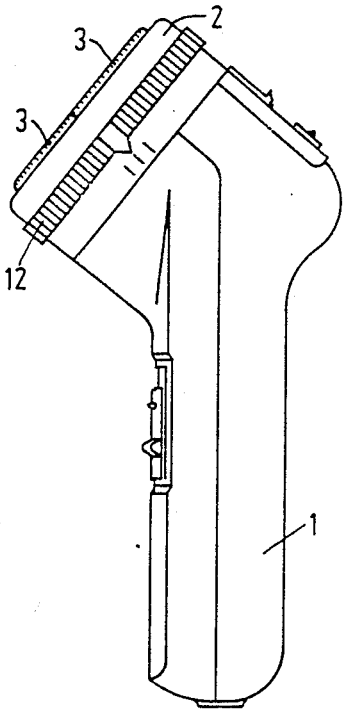
FIG. 2 is a side view of the shaving apparatus shown in FIG. 1.
Figure 3:
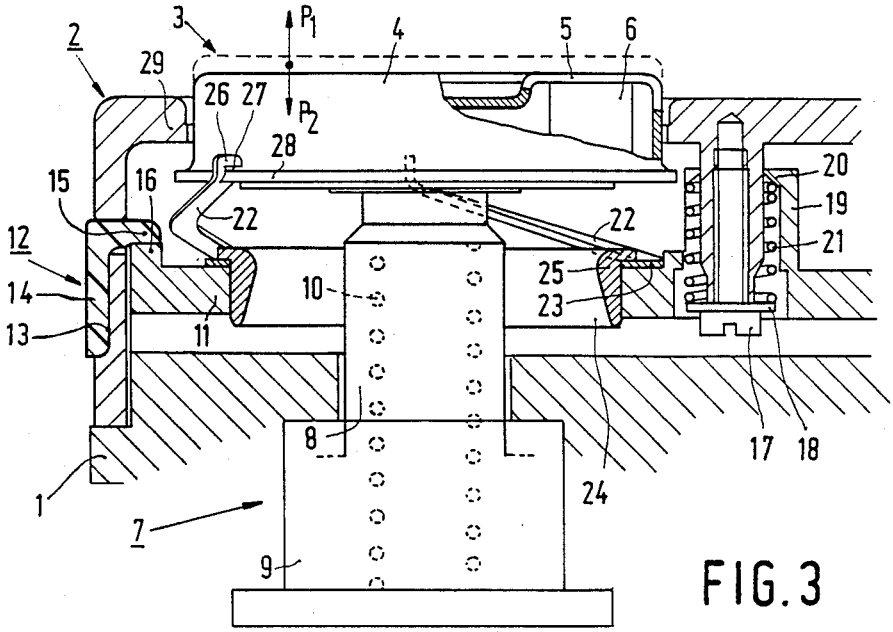
FIG. 3 is a sectional view taken on the line III—III in FIG. 1.
Figure 4:
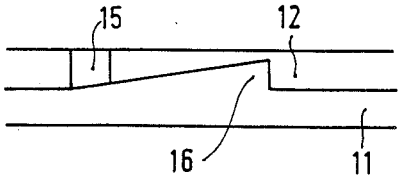
FIGS. 4 and 5 show diagrammatically a development of a part of the adjusting mechanism.
Figure 5:
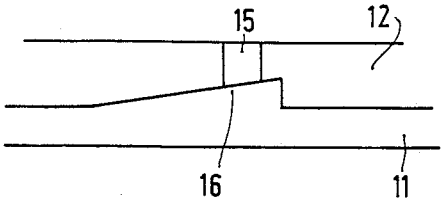

The shaving apparatus shown in the Figures comprises a housing 1 with a holder 2 for three shaving units 3. A shaving unit 3 comprises an external shaving member 4 with hair entry apertures 5 and an internal shaving member 6 which is rotatable relative to the external shaving member. By means of a drive shaft 7 the internal shaving member 6 is coupled to a drive mechanism, generally an electric motor, which is accommodated in the housing 1 and which is not shown for the sake of simplicity. The drive shaft 7 comprises two portions 8 and 9 which are axially movable relative to one another and between which a compression spring 10 is arranged. In this way the internal shaving member 6 is urged against the inner side of the external shaving member 4. The holder 2 carries a mounting plate 11 for the shaving units 3. The position of the mounting plate 11 relative to the holder is adjustable by means of an adjusting member 12, which is arranged in a recess 13 in the holder wall. This adjusting member 12 comprises an annular base 14 provided with equidistantly spaced inwardly directed adjustment projections 15. At corresponding locations the mounting plate is provided with run-on projections 16. By moving the adjusting member 12 in the recess 13 the location where an adjustment projection 15 is in contact with a run-on projection 16 can be changed, see FIGS. 4 and 5. This also enables the distance between the holder 2 and the mounting plate 11 to be varied in an axially outward or axially inward direction, as is indicated by the arrows $P_1$ and $P_2$, respectively (FIG. 3). The holder 2 is provided with a central bolt 17 with a spring cap 18. The bolt 17 is situated between three upright limbs 19 which form part of the mounting plate 11. The limbs 19 carry inwardly directed hook-shaped end portions 20. Between the hook-shaped end portions 20 and the spring cap 18 a compression spring 21 is arranged, so that the mounting plate 11 is subjected to a force acting in the axially outward direction $P_1$, thereby ensuring that the run-on projections 16 always engage against the adjustment projections 15.

An external shaving member 4 is secured to the mounting plate 11 by means of three resilient elements 22. These resilient elements 22 form part of a substantially circular base 23 of a sheet material having resilient characteristics. The base 23 is situated around an opening 24 formed in the mounting plate 11 for the passage of the drive shaft 7. The base 23 is secured to the mounting plate 11 by means of the annular clamping member 25. The bent end portion 26 of a resilient element 22 is formed with a recess 27 which is engaged by the flange 28 of the external shaving member 4.

The characteristics of the resilient elements 22 and the compression spring 10 in the drive shaft 7 have been selected in such a way that the forces exerted on the external shaving member 4 by the resilient elements 22 in the direction $P_2$ are in balance with the force in the direction $P_1$ exerted on the external shaving member 4 by the compression spring 10 via the internal shaving member 6. In contrast with the known shavers, the present embodiment therefore does not need reactive forces in the direction $P_2$ exerted on the flange 28 of the external shaving member 4 by the rim 29 of the holder 2 in order to obtain said balance of forces.

In this way the external shaving units 3 together with the mounting plate 11 can be moved relative to the holder 2 in the axial directions $P_1$ and $P_2$. The stiffness of the compression spring 10 is such that it has only a minimal effect on the position of a shaving unit 3.

Figure 7:
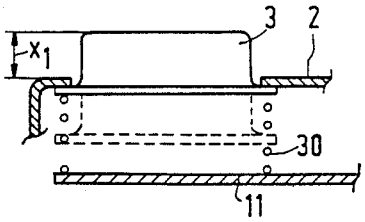
FIGS. 7 and 8 are diagrammatic and simplified sectional views similar to that shown in FIG. 3, showing the external shaving member in different positions.
Figure 8:
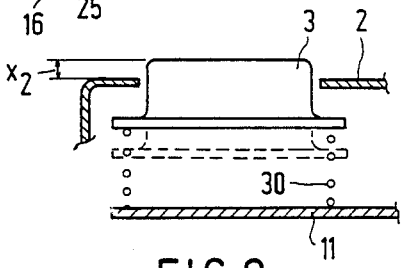

FIGS. 7 and 8 show two different positions of the mounting plate 11 relative to the holder 2 and hence of a shaving unit 3 relative to the holder 2.

Figure 6:
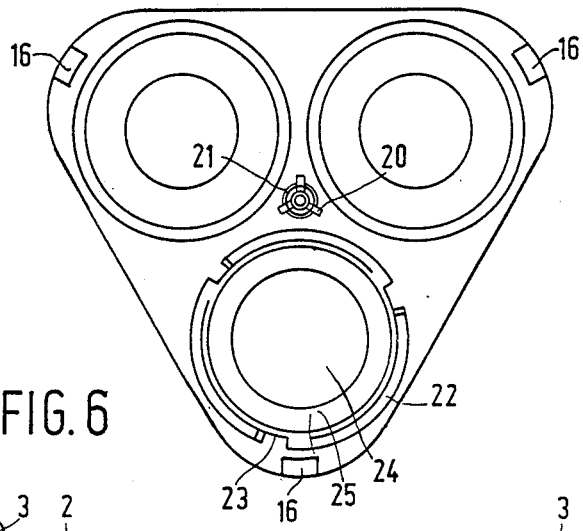
FIG. 6 is a plan view of the mounting plate with the shaving units, one shaving unit not being shown.

As an alternative the resilient elements 22 shown in FIGS. 3 and 6 are replaced by a helical spring 30. The helical spring 30 must be secured both to the mounting plate 11 and to the external shaving member 4, for example by spot-welding.

Figure 9:
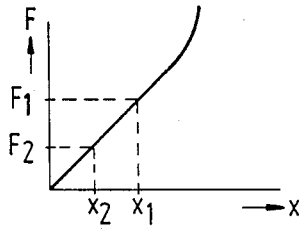
FIG. 9 is a graph of a spring characteristic.

In the situation illustrated in FIG. 7 a shaving unit 3 projects from the holder 2 over a maximum distance $X_1$. As a result of the contact with the skin during shaving the shaving unit can be depressed over the maximum distance $X_1$, so that the maximum force $F_1$ (FIG. 9) is exerted on the skin. However, if by means of the adjusting member 12 the mounting plate 11 is adjusted in such a way that the shaving unit projects from the holder over a smaller distance $X_2$ (FIG. 8) this also reduces the maximum force $F_2$ (FIG. 9) which can occur between the shaving unit and the skin. For the sake of simplicity the effect of the spring 21, which has a substantially higher stiffness than the resilient elements 22 together, is ignored.

In the manner described above the user of a shaving apparatus can adjust the maximum force with which an external shaving member 4, and hence the entire shaving unit, acts against the skin, to adapt this maximum force to his personal preference.

During shaving it may happen that the external shaving member is pressed inwards over the maximum distance relative to the unloaded situation (FIG. 7), i.e. so far that the external shaving member no longer projects from the holder 2. With the maximum force which then occurs between the skin to be shaved and the external shaving member it may occur that the skin slightly penetrates the hair-entry apertures 5 and is grazed by the internal shaving member 6. This irritation is generally not observed until after shaving.

Since each external shaving member 4 is supported separately relative to the mounting plate 11, for example by means of the resilient elements 22 or the helical spring 30, said shaving units can move in the directions $P_1$ and $P_2$ substantially independently of one another in the case of an apparatus comprising a plurality of shaving units 3. Moreover, a shaving unit 3 can be tilted to a limited extent relative to these directions. Thus, the shaving units 3 can readily adapt themselves to the shape of the skin to be shaved.

The compression spring 10 inside the drive shaft 7 need only provide the shaving pressure between the internal and the external shaving member, which minimizes the loss of energy as a result of friction between the shaving members 4 and 6.

What is claimed is:

1. A shaving apparatus comprising a housing provided with a holder for at least one shaving unit, which shaving unit comprises an external shaving member with hair-entry apertures and an internal shaving member which is rotatable relative to the external shaving member, which internal shaving member is coupled to a drive mechanism by means of a drive shaft comprising at least two portions which are axially movable relative to each other, the holder being provided with a mounting plate for the shaving unit, which holder and mounting plate are movable relative to one another in axially inward and outward directions, characterized in that the external shaving member is secured to the mounting plate by means of at least one resilient element, so that the external shaving member with the mounting plate is also movable relative to the holder in both axial directions.

2. A shaving apparatus comprising a housing provided with a holder for at least one shaving unit, which shaving unit comprises an external shaving member with hair-entry apertures and an internal shaving member which is rotatable relative to the external shaving member, which internal shaving member is coupled to a drive mechanism by means of a drive shaft comprising at least two portions which are axially movable relative to each other, the holder being provided with a mounting plate for the shaving unit, which holder and mounting plate are movable relative to one another in axially inward and outward directions, wherein the external shaving member is secured to the mounting plate by means of plate springs, the end of a plate spring being formed with a recess in which a flange of the external shaving member engages, so that the external shaving member with the mounting plate is also movable relative to the holder in both axial directions.

3. A shaving apparatus as claimed in claim 2 comprising a holder for a plurality of shaving units and wherein the mounting plate is secured to the holder by means of a central resilient element and is axially movable relative to the holder by means of an annular adjusting member.

4. A shaving apparatus comprising a housing provided with a holder for a plurality of shaving units each of said shaving unit comprising an external shaving member with hair-entry apertures and an internal shaving member which is rotatable relative to the external shaving member, which internal shaving member is coupled to a drive mechanism by means of a drive shaft comprising at least two portions which are axially movable relative to each other, the holder being provided with a mounting plate for the shaving unit, which holder and mounting plate are movable relative to one another in axially inward and outward directions wherein the external shaving member is secured to the mounting plate by means of at least one resilient element, so that the external shaving member with the mounting plate is also movable relative to the holder in both axial directions and the mounting plate is secured to the holder by means of a central resilient element and is axially movable relative to the holder by means of an annular adjusting member.

* * * * *